US010683650B1

(12) United States Patent
Wang

(10) Patent No.: US 10,683,650 B1
(45) Date of Patent: Jun. 16, 2020

(54) TOILET PLUNGER STRUCTURE

(71) Applicant: CHNTUO INDUSTRIAL CO., LTD., Chia-Yi (TW)

(72) Inventor: Jung-Shih Wang, Chia-Yi (TW)

(73) Assignee: CHINTUO INDUSTRIAL CO., LTD., Chia-Yi (TW)

( * ) Notice: Subject to any disclaimer, the term of this patent is extended or adjusted under 35 U.S.C. 154(b) by 0 days.

(21) Appl. No.: 16/282,542

(22) Filed: Feb. 22, 2019

(51) Int. Cl.
*E03C 1/308* (2006.01)

(52) U.S. Cl.
CPC ..... *E03C 1/308* (2013.01)

(58) Field of Classification Search
CPC ..... E03C 1/304; E03C 1/306; E03C 1/308; B08B 9/0328; B08B 9/0321; B08B 9/0325
USPC ..... 4/255.01–255.12
See application file for complete search history.

(56) References Cited

U.S. PATENT DOCUMENTS 5,239,708 A * 8/1993 Irwin ..... E03C 1/308 4/255.03
5,249,311 A * 10/1993 Rau ..... E03C 1/306 15/406
6,032,301 A * 3/2000 Wang ..... B08B 9/0321 15/406
6,550,074 B1 * 4/2003 Allenbaugh ..... B08B 9/0321 4/255.01
7,213,273 B2 * 5/2007 Wang ..... E03C 1/308 4/255.01
7,350,265 B2 * 4/2008 Zhang ..... B08B 9/055 15/406
7,806,256 B2 * 10/2010 Wildauer ..... E03C 1/308 206/15.3
9,255,390 B2 * 2/2016 Park, II ..... E03C 1/304
10,329,754 B1 * 6/2019 Wang ..... E03C 1/308

FOREIGN PATENT DOCUMENTS

CN 104080383 B 2/2017

* cited by examiner

*Primary Examiner* — David P Angwin
*Assistant Examiner* — Nicholas A Ros
(74) *Attorney, Agent, or Firm* — Rosenberg, Klein & Lee

(57) ABSTRACT

A toilet plunger structure is disclosed. It comprises a shell having a handle, a trigger pivotally connected to the handle and having a push part, an accommodating slot corresponding to the push part for accommodating a gas container and a positioning slot; a smasher having a positioning seat accommodated in the positioning slot of the shell and having a positioning hole and a firing pin disposed in the positioning hole; a gas pipe provided with a connecting pipe having a connecting seat connected to the positioning seat for fixation, a protecting pipe sleeved on the connecting pipe and a connecting member connected to the protecting pipe; and a dredge connector having a connecting part for correspondingly connecting the connecting member, a plugging part disposed at a bottom of the connecting part and a though hole passing through the connecting part to the plugging part for receiving the connecting pipe.

6 Claims, 8 Drawing Sheets

TOILET PLUNGER STRUCTURE

BACKGROUND OF THE INVENTION

1. Field of the Invention

The present invention relates to a toilet plunger structure which comprises a smasher to easily smash an opening of a gas container to increase the convenience of use and prevents affecting the air pressure due to air leaks to achieve an excellent unclogging effect.

2. Description of Related Art

Generally, when a pipe or a toilet is plugged up, a toilet plunger is used to unclog the pipe or the toilet. A traditional toilet plunger comprises a handle connected with a bowl-shaped rubber adsorption cup at a bottom of the handle. When the rubber adsorption cup is pressed against the toilet by a user applying a force on the handle, the pressure inside the rubber adsorption cup is altered by repeated suction and thrust so that a plugged region can be cleared. However, the traditional toilet plunger cannot clear a plugged toilet efficiently since the pressure alternation generated by repeated pressing the rubber adsorption cup against the toilet is limited. Even though objects plugged in the toilet can be stirred by the pressure alternation generated by the rubber adsorption cup of the traditional toilet plunger, the toilet is easily plugged by these objects again.

The China Pat. No. CN 104080383 B, issued on 15 Feb. 2017, has disclosed a toilet purging apparatus. It comprises a pipe body having a longitudinally movable gas channel through the pipe body; a firing unit having a firing pin for vertical movement and a switch coupled to an upper end of the pipe body for moving the firing pin to the pipe body when being pressed; a tightening cap screwed to a top of the firing unit; a gas container disposed between the firing unit and the tightening cap for moving the gas container to contact the firing pin closely when being turned; and a connector coupled to a lower end of the pipe body and inserted into a drain pipe of a toilet.

Although the toilet purging apparatus described above achieves an expected effect of clearing the toilet efficiently, it is not convenient enough to use. For instance, the gas container is inserted into a bottom tub of the firing unit, and the tightening cap is screwed to push the gas container to make the firing pin pierce into an injection port of the gas container. When the switch is pressed to push a lock bar, the gas is ejected from the gas container as the firing pin moves with the lock bar. The abovementioned structure also has the following disadvantages:

1. If the tightening cap is not screwed accurately, the tightening cap cannot accurately push the gas container to make the firing pin pierce into the injection port, so the gas in the gas container cannot be ejected.

2. The abovementioned structure has air leaks problem before the switch is pressed due to that the tightening cap must first push the gas container to make the firing pin pierce into the injection port before the switch is pressed and the firing pin moves with the lock bar. In such a case, the gas container having insufficient air pressure cannot eject enough gas after the switch is pressed, which decreases the effects of unclogging the pipe or the toilet, so the structure of the toilet purging apparatus still needs to be improved.

SUMMARY OF THE INVENTION

In view of the above-mentioned problems, the object of the present invention is to provide a toilet plunger structure which comprises a smasher to easily smash an opening of a gas container to increase the convenience of use and prevents affecting the air pressure due to air leaks to achieve an excellent unclogging effect.

DETAILED DESCRIPTION OF THE PREFERRED EMBODIMENT

Hereinafter, an exemplary embodiment of the present invention will be described in detail with reference to the accompanying drawings.

Figure 1:
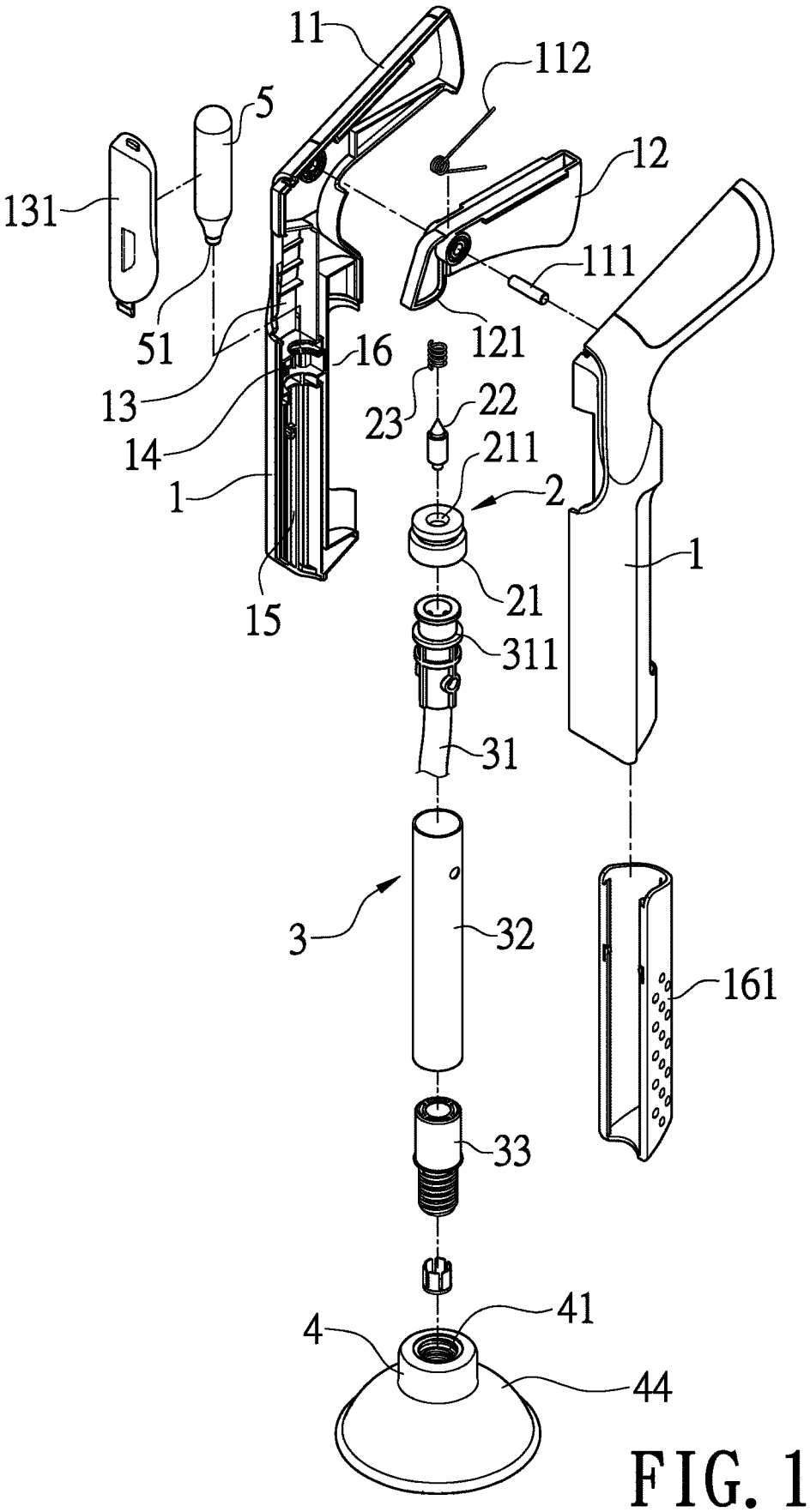
FIG. 1 is an exploded view showing a first embodiment for a toilet plunger structure according to the present invention.
Figure 2:
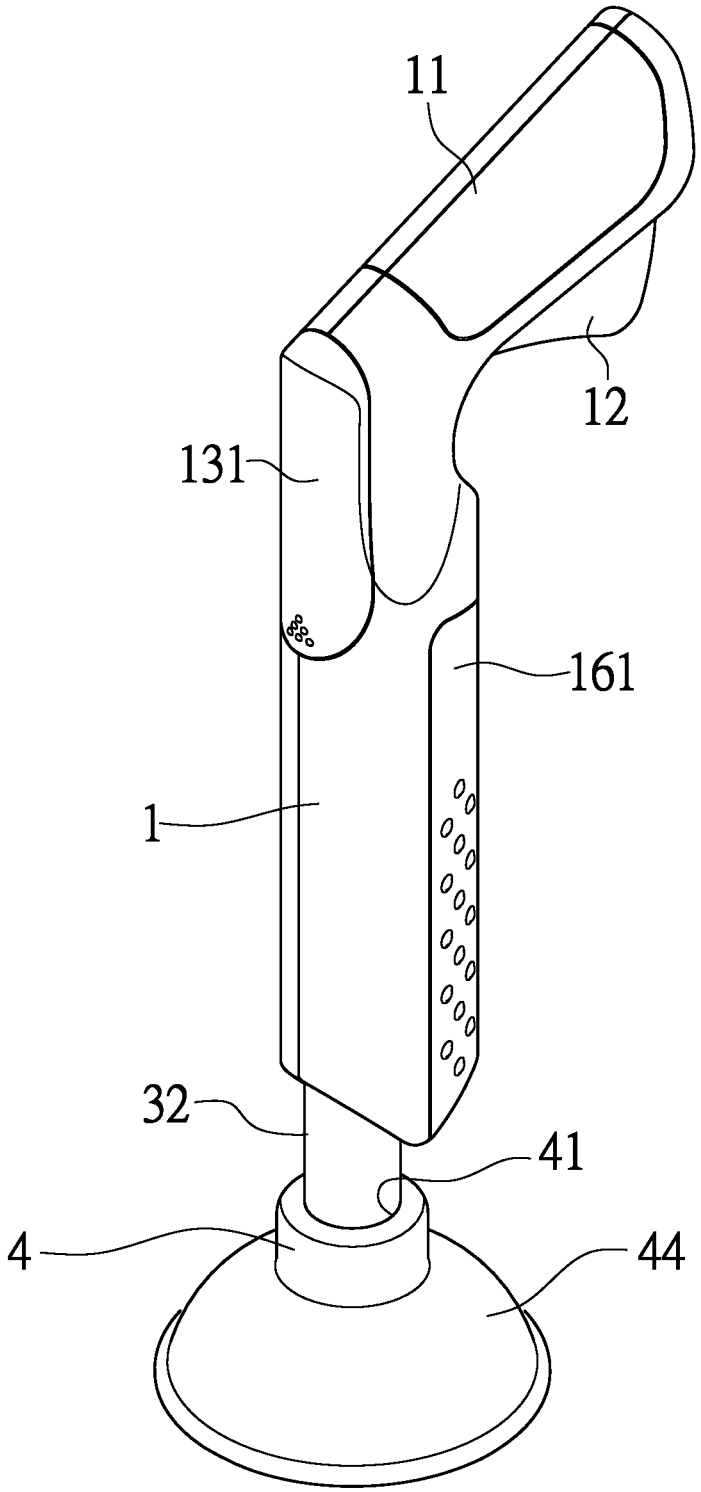
FIG. 2 is a stereogram showing the first embodiment for the toilet plunger structure in assembly according to the present invention.
Figure 3:
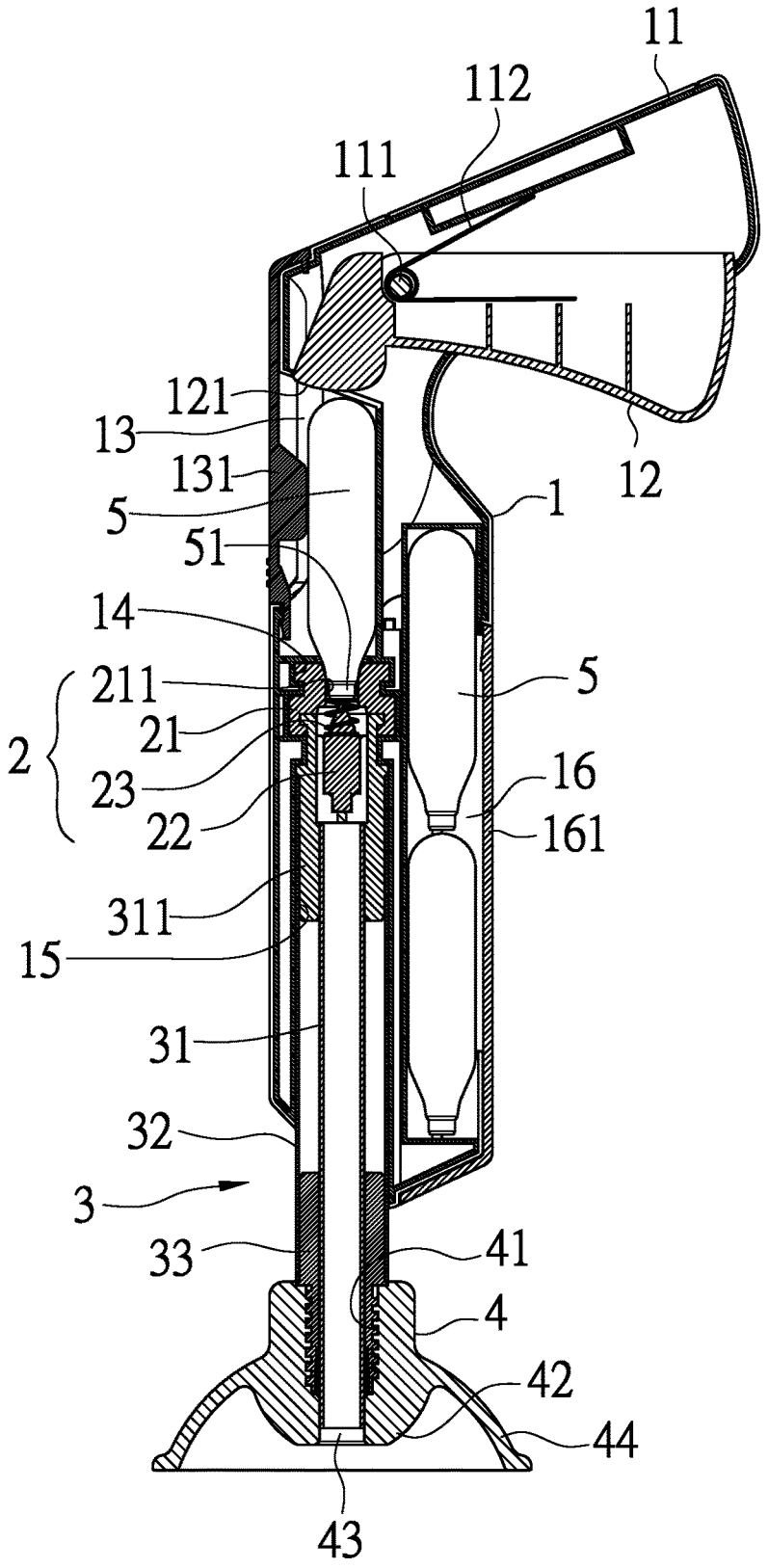
FIG. 3 is a cross-sectional view showing the first embodiment for the toilet plunger structure in assembly according to the present invention.

As showed in FIG. 1, FIG. 2 and FIG. 3, an exploded view, a stereogram and a cross-sectional view showing a first embodiment for a toilet plunger structure according to the present invention are respectively disclosed. The toilet plunger structure mainly comprises a shell (1), a smasher (2), a gas pipe (3) and a dredge connector (4).

The shell (1) is provided with a handle (11), a trigger (12), an accommodating slot (13), a positioning slot (14), a joint part (15) and an auxiliary accommodation space (16). The handle (11) has a pivot member (111) pivotally connected to the trigger (12) and an elastic member (112) disposed between the handle (11) and the trigger (12) for pushing against the trigger (12) outwardly. The trigger (12) has a push part (121) accommodated in the shell (1). The accommodating slot (13) corresponds to the push part (121) for accommodating a gas container (5) and has a lid (131) actively disposed outside the shell (1). The positioning slot (14) communicates with the accommodating slot (13) and the joint part (15) communicates with the positioning slot (14). The auxiliary accommodation space (16) is used to accommodate at least one gas container (5) and further has a cover (161).

The smasher (2) is provided with a positioning seat (21) accommodated in the positioning slot (14) of the shell (1) and having a positioning hole (211) corresponding to an opening (51) of the gas container (5), a firing pin (22) disposed in the positioning hole (211) and an elastic supporting member (23) between an inner edge of the positioning hole (211) and the firing pin (22). Preferably, the positioning seat (21) is made of a soft material and has an air-tight effect.

The gas pipe (3) is disposed in the joint part (15) of the shell (1) and provided with a connecting pipe (31) having a connecting seat (311) connected to the positioning seat (21) of the smasher (2) for fixation, a protecting pipe (32) sleeved on the connecting pipe (31) and having one end connected to the connecting seat (311) for fixation, and a connecting member (33) connected to the other end of the protecting pipe (32). One end of the connecting pipe (31) is protruded from the connecting member (33).

The dredge connector (4) is provided with a connecting part (41) for correspondingly connecting the connecting member (33) of the gas pipe (3), a plugging part (42) disposed at a bottom of the connecting part (41), a though hole (43) passing through the connecting part (41) to the plugging part (42) for receiving the connecting pipe (31), and a cup (44) outside the plugging part (42) for preventing air leaks and achieving an air-tight effect.

Figure 4:
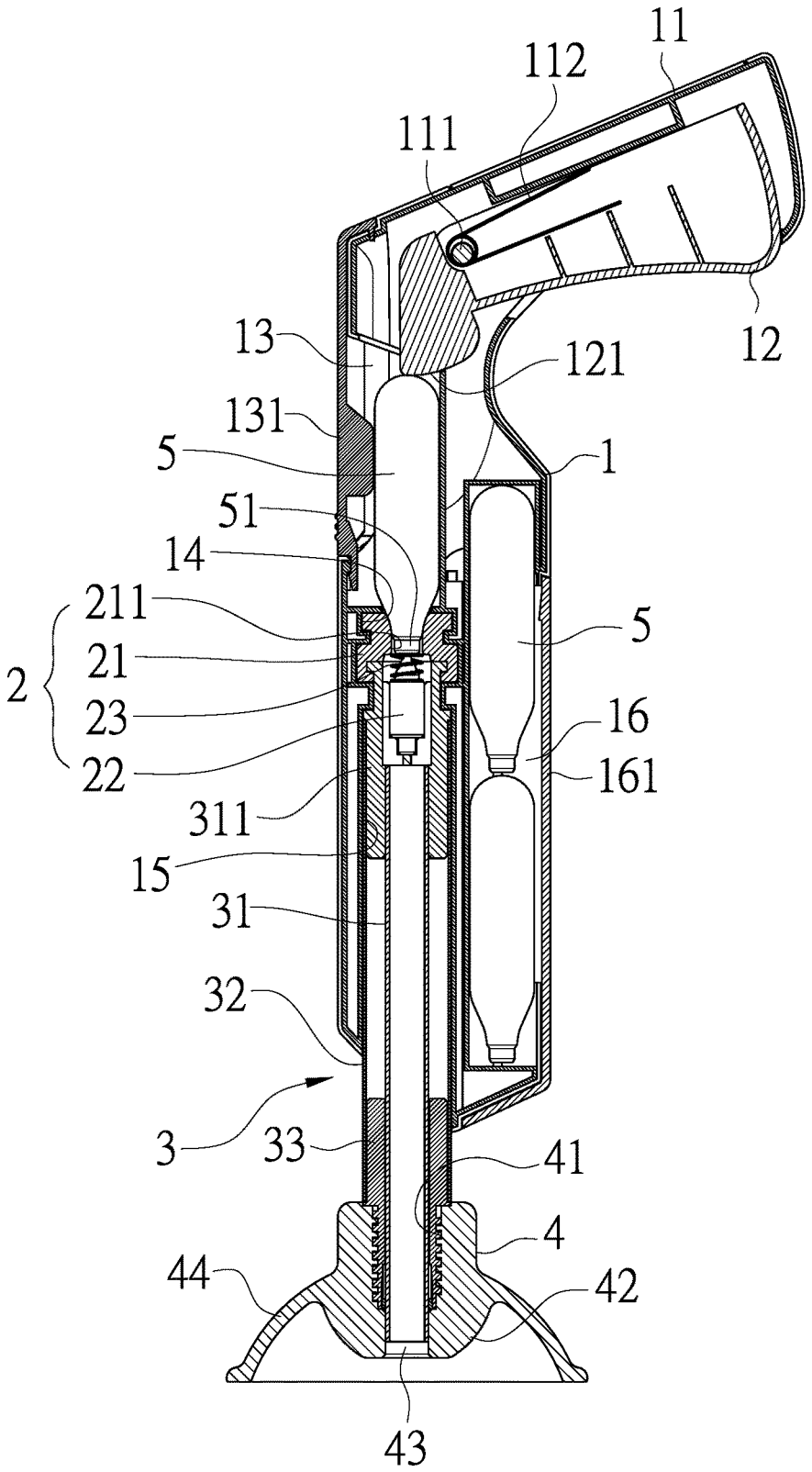
FIG. 4 is a cross-sectional view showing the first embodiment for the toilet plunger structure in use according to the present invention.

In a practical use of the present invention, the plugging part (42) of the dredge connector (4) is correspondingly stuffed into a water pipe or a toilet to be unclogged. The gas container (5) is disposed in the accommodating slot (13) of the shell (1), and the lid (131) is covered on the accommodating slot (13). When the trigger (12) is pressed by a user applying a force to compress the elastic member (112), the push part (121) of the trigger (12) pushes the gas container (5) towards the positioning seat (21) of the smasher (2), so that the opening (51) of the gas container (5) is inserted into the positioning hole (211) to compress the elastic supporting member (23) and further hit the firing pin (22) to pierce into the opening (51) of the gas container (5) as shown in FIG. 4. When the trigger (12) is released by the user, the elastic member (112) rebounds and pushes the trigger (12) outward, and the elastic supporting member (23) also pushes the opening (51) of the gas container (5) away from the firing pin (22). Therefore, the air contained in the gas container (5) instantaneously passes from the opening (51) through the positioning hole (211) to the connecting pipe (31) of the gas pipe (3) and instantaneously ejected from the connecting pipe (31) to the though hole (43) of the dredge connector (4) so as to achieve the function of clearing the plugged water pipe or the toilet.

Figure 5:
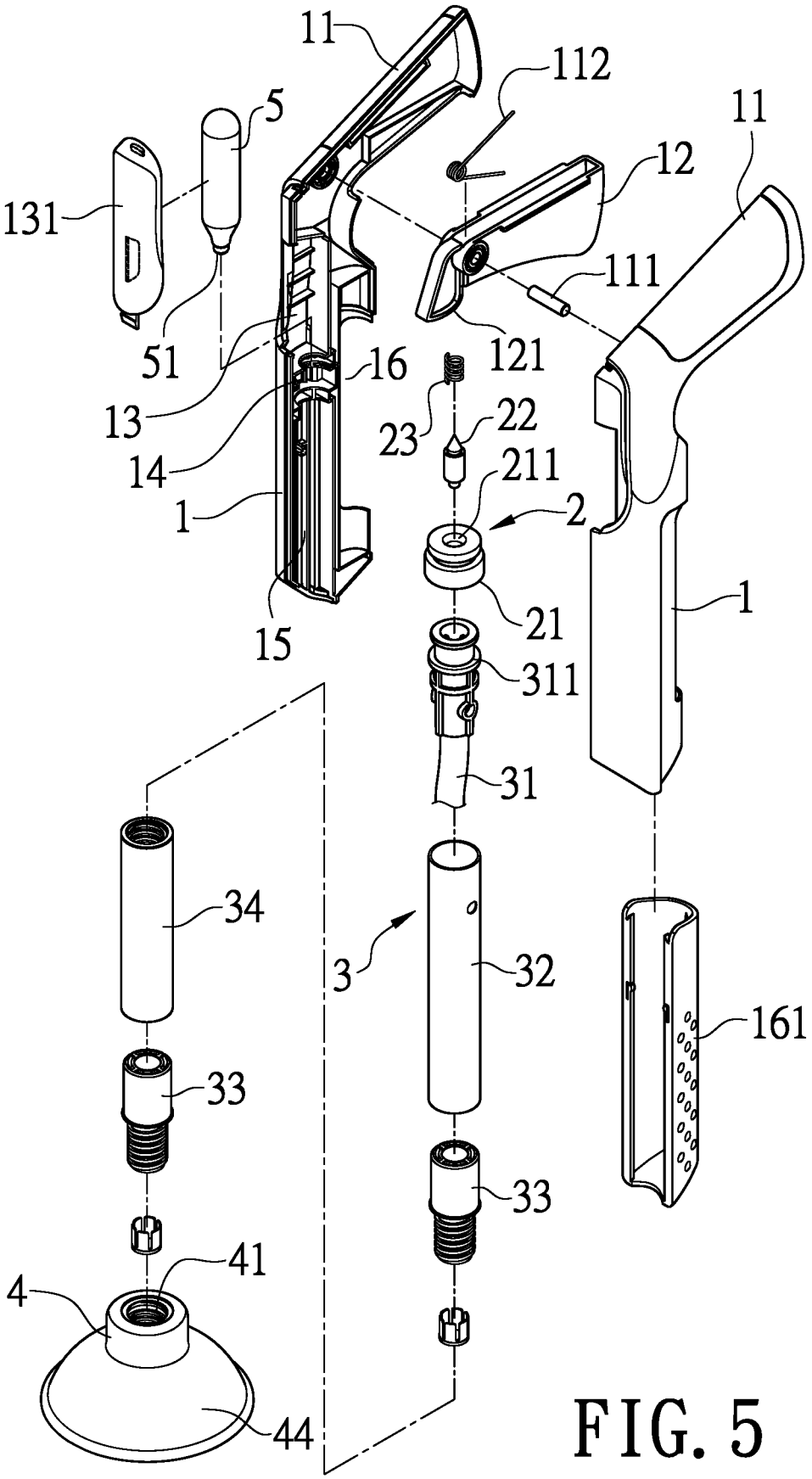
FIG. 5 is an exploded view showing a second embodiment for a toilet plunger structure according to the present invention.
Figure 6:
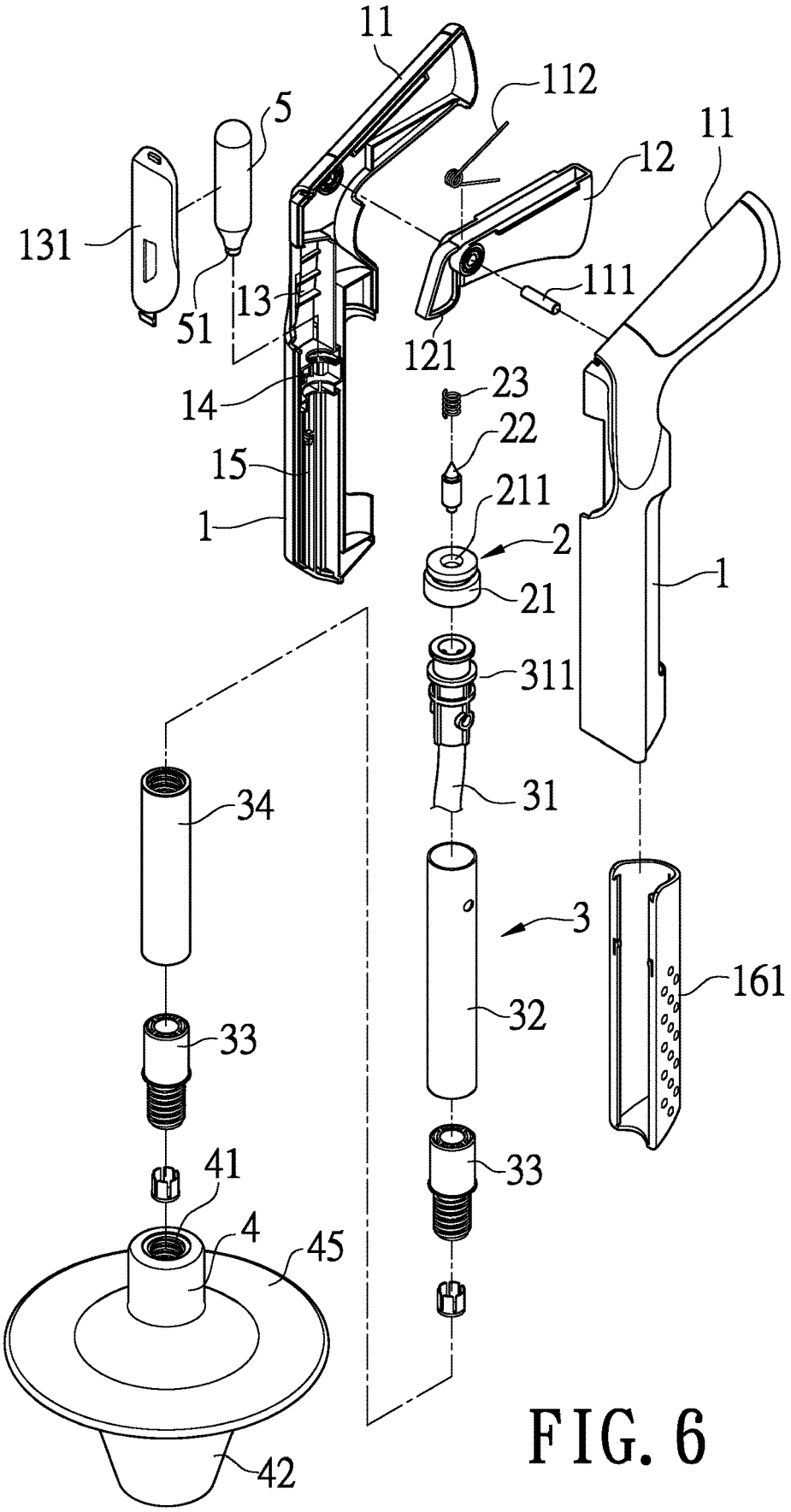
FIG. 6 is an exploded view showing a third embodiment for a toilet plunger structure according to the present invention.

Referring to FIG. 5 and FIG. 6, an exploded view showing a second embodiment and an exploded view showing a third embodiment for a toilet plunger structure according to the present invention are respectively disclosed. The gas pipe (3) is further provided with an extension pipe (34) connected to the connecting member (33) at one end thereof to increase the length of the gas pipe (3). Furthermore, the extension pipe (34) is connected with another connecting member (33) at the other end thereof for connection with the connecting part (41) of the dredge connector (4).

Figure 7:
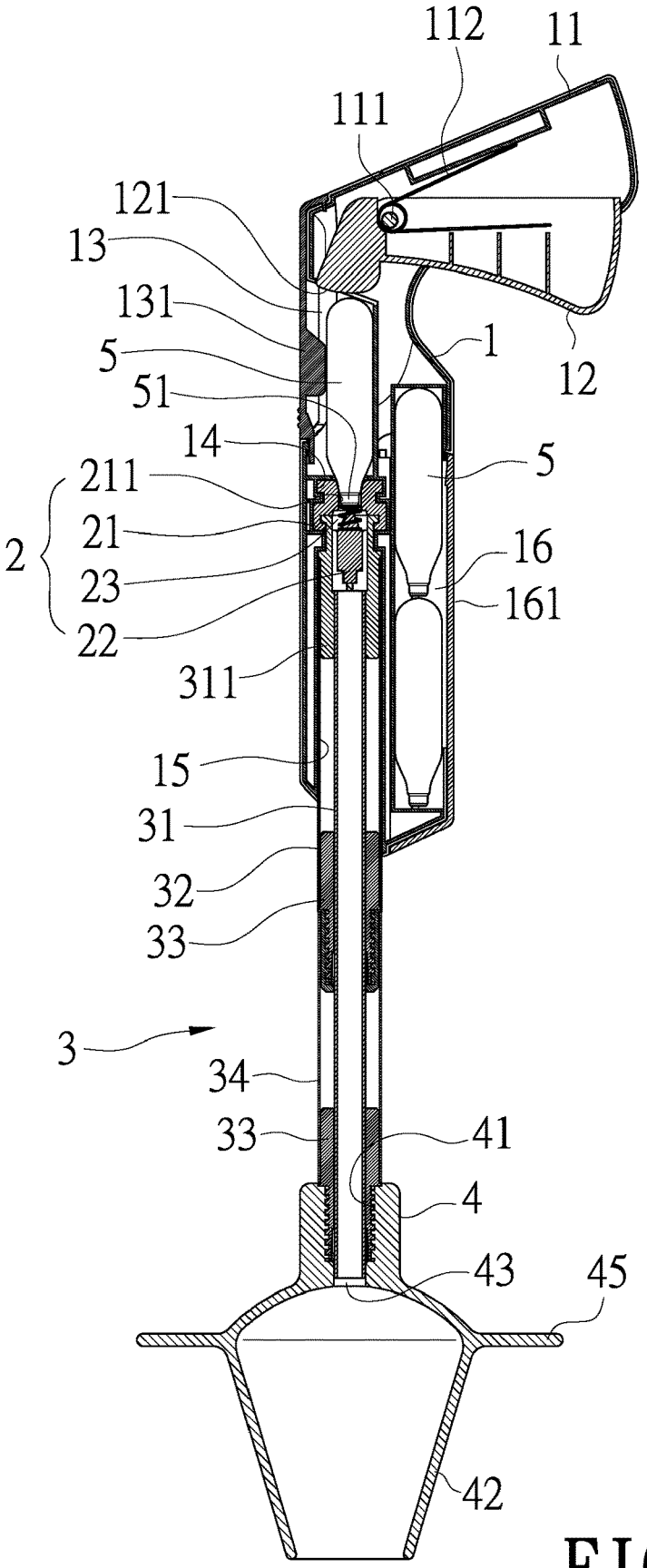
FIG. 7 is a cross-sectional view showing the third embodiment for the toilet plunger structure in assembly according to the present invention.

As showed in FIG. 6 and FIG. 7, the exploded view showing a third embodiment for a toilet plunger structure according to the present invention and a cross-sectional view showing the third embodiment for the toilet plunger structure in assembly according to the present invention are disclosed. The dredge connector (4) is further provided with a shield blade (45) outside the plugging part (42). When the plugged toilet is unclogged, the shield blade (45) prevents the water in the toilet from splashing outward.

Figure 8:
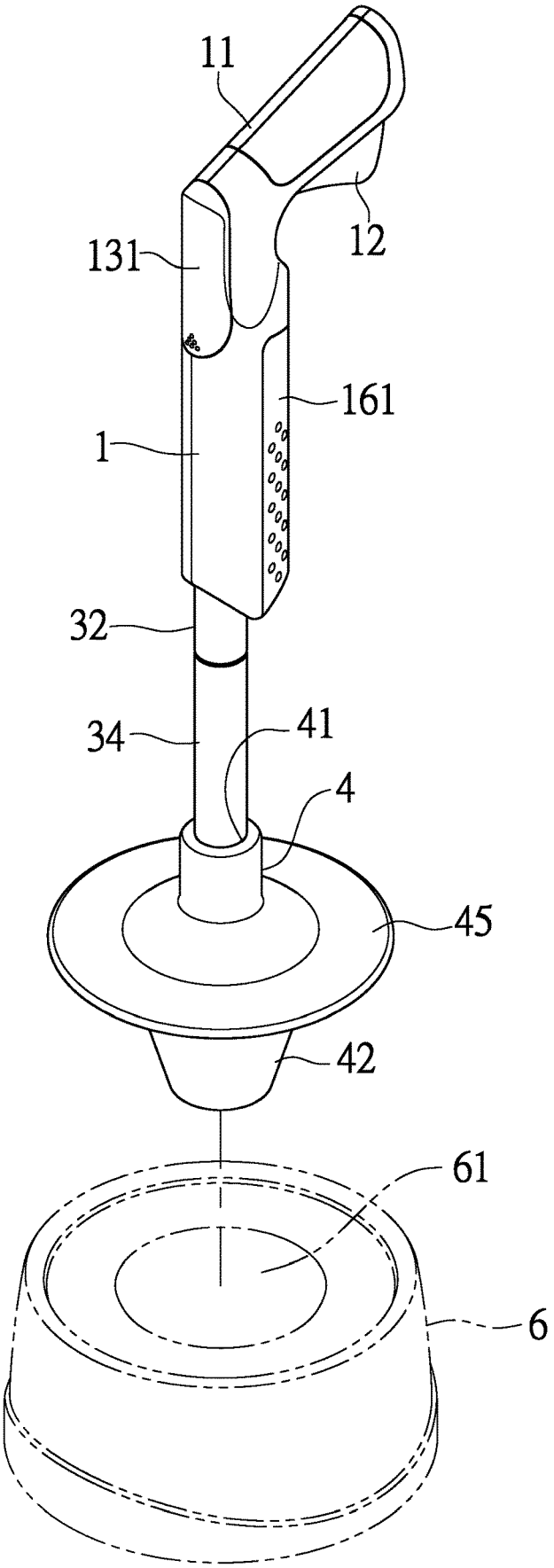
FIG. 8 is a stereogram showing the third embodiment for the toilet plunger structure in assembly according to the present invention.

Additionally, referring to FIG. 8, a stereogram showing the third embodiment for the toilet plunger structure in assembly according to the present invention is revealed. The dredge connector (4) is further connected with a storage seat (6) having a containing groove (61) for correspondingly receiving and positioning the dredge connector (4).

Compared with the technique available now, the present invention has the following advantages:

1. The present invention can easily smash the opening of the gas container to increase the convenience of use by pressing the trigger and by the push part of the trigger pushing the gas container to make the firing pin hit and pierce into the opening of the gas container.

2. After the trigger is pressed to smash the opening of the gas container, the air contained in the gas container can be ejected instantaneously for unclogging when the trigger is released, so the present invention prevents affecting the air pressure due to air leaks during the operation and achieves an excellent unclogging effect.

What is claimed is:

1. A toilet plunger structure, comprising:

a shell having a handle, a trigger having a push part, an accommodating slot corresponding to the push part for accommodating a gas container, a positioning slot communicated with the accommodating slot and a joint part communicated with the positioning slot, wherein the handle is provided with a pivot member pivotally connected to the trigger and an elastic member disposed between the handle and the trigger for pushing against the trigger outwardly, and the accommodating slot is correspondingly provided with a lid outside the shell;

a smasher having a positioning seat accommodated in the positioning slot of the shell, a firing pin and an elastic supporting member, wherein the positioning seat is provided with a positioning hole corresponding to an opening of the gas container for accommodating the firing pin, and the elastic supporting member is disposed between an inner edge of the positioning hole and the firing pin;

a gas pipe disposed in the joint part of the shell and provided with a connecting pipe having a connecting seat connected to the positioning seat of the smasher for fixation, a protecting pipe sleeved on the connecting pipe and having one end connected to the connecting seat for fixation, and a connecting member connected to the other end of the protecting pipe, wherein the connecting pipe has one end protruded from the connecting member; and a dredge connector having a connecting part for correspondingly connecting the connecting member of the gas pipe, a plugging part disposed at a bottom of the connecting part, and a though hole passing through the connecting part to the plugging part for receiving the connecting pipe.

2. The toilet plunger structure as claimed in claim 1, wherein the shell is provided with an auxiliary accommodation space having a cover for accommodating at least one gas container.

3. The toilet plunger structure as claimed in claim 1, wherein the gas pipe is further provided with an extension pipe connected to the connecting member at one end thereof, and wherein the extension pipe is further connected with another connecting member at the other end thereof for connection with the connecting part of the dredge connector.

4. The toilet plunger structure as claimed in claim 1, wherein the dredge connector is further provided with a cup outside the plugging part.

5. The toilet plunger structure as claimed in claim 1, wherein the dredge connector is further provided with a shield blade outside the plugging part.

6. The toilet plunger structure as claimed in claim 1, further comprising a storage seat having a containing groove for correspondingly receiving and positioning the dredge connector.

* * * * *